United States Patent [19]

Campbell

[11] 4,050,164

[45] Sept. 27, 1977

[54] GRAIN DRYER CONSTRUCTION

[75] Inventor: Bowen Campbell, Des Moines, Iowa

[73] Assignee: Cromwell B. Campbell

[21] Appl. No.: 664,869

[22] Filed: Mar. 8, 1976

[51] Int. Cl.[2] ..... F26B 11/22

[52] U.S. Cl. ..... 34/182; 34/216; 34/225; 34/233

[58] Field of Search ..... 34/181, 182, 22, 233, 34/212, 216, 217, 225, 77; 62/238, 324

[56] References Cited

U.S. PATENT DOCUMENTS

| | | | |
|---|---|---|---|
| 1,119,011 | 12/1914 | Grosvenor | 62/238 |
| 2,249,563 | 7/1941 | Knox | 34/181 |
| 2,363,037 | 11/1944 | Arnold | 34/182 |
| 2,799,947 | 7/1957 | Elwess | 34/77 |
| 3,371,504 | 3/1968 | Brindley | 62/324 |
| 3,397,552 | 8/1968 | Harnish | 62/324 |
| 3,475,832 | 11/1969 | Kuelling | 34/182 |

*Primary Examiner*—John J. Camby
*Assistant Examiner*—Larry I. Schwartz
*Attorney, Agent, or Firm*—Allegretti, Newitt, Witcoff & McAndrews

[57] ABSTRACT

An improved method for batch drying grain and the like utilizes a plurality of separate batch bins having hot, drying air inlets, transfer air outlets and inlets, and return air outlets. The hot, drying air inlets are connected by a common duct as are the transfer air outlets and inlets. The return air outlets are also connected with a common duct or ducts. The common return duct or ducts connect the outlets to a fan chamber. Air in the fan chamber is dehydrated and heated by a heat pump before being directed into the common hot, drying air supply duct. Air is circulated among the batch bins by arranging various combinations and permutations of supply, transfer and return inlet and outlet openings before it is recycled through the fan chamber and heat pump coils.

6 Claims, 9 Drawing Figures

GRAIN DRYER CONSTRUCTION

BACKGROUND OF THE INVENTION

In a principal aspect, the present invention relates to an improved method for batch drying grain and the like.

Previously, in U.S. Pat. No. 2,826,824, Drying Method, issued Mar. 18, 1958, a method for batch drying grain is disclosed. In general, a plurality of separate bins are filled with grain for drying. A series of doors in the upper and lower sides of the bins are connected with manifolds or common ducts. Doors are also arranged to interconnect the manifolds. By appropriately opening and closing various doors, it is possible to cycle the air supplied to the bins in a sequential manner. After the air is cycled as desired, it exhausts through a trap door in the top of a bin. Various arrangements of doors are employed to permit filling and removal of grain from the separate bins as other bins of grain are being dried.

During particularly cold weather, the exhausted air is sufficiently above ambient temperature that great amounts of energy are lost from the drying system. Also, the heat of vaporization of the moisture evaporated from the product is lost. This decreases the efficiency of the grain drying operation, since cold ambient air must be heated in order to maintain a continuous supply of dry, heated air for simultaneously drying the separate batches of grain. The capacity of the drying system is also reduced when the weather is particularly warm and humid. Such disadvantages are the type which the subject matter of the present invention seeks to overcome.

SUMMARY OF THE INVENTION

In a principal aspect, the present invention provides a method and apparatus for batch drying of grain and similar material wherein heated air which is used to dry the grain is recycled preferably using a heat pump mechanism. In this manner, the efficiency and capacity of the drying operation is enhanced and the drying operation is not critically affected by external ambient temperatures and humidities. Separate batch bins are connected by means of air tight doors and manifold ducts in a fashion similar to that shown in U.S. Pat. No. 2,826,824. Additionally, a single hot, drying air supply manifold duct, a single air transfer manifold and return or exhaust manifold duct or ducts are provided. The return manifold or manifolds receive air from selected batch bins for recycling. The air is dried and reheated preferably by a heat pump mechanism. The air is continuously circulated by a fan mechanism.

It is thus an object of the present invention to provide an improved batch grain drying method and apparatus wherein the drying medium is recycled.

It is a further object of the present invention to provide an improved batch grain drying operation wherein a heat pump is utilized for drying and reheating recycled air.

Still a further object of the present invention is to provide a batch grain drying method and apparatus utilizing a plurality of bins which may be arranged for flow of drying medium therethrough in a variety of sequences, the drying medium being recycled through a drying and reheating process.

Still a further object of the present invention is to provide a means for modifying various existing batch grain drying facilities so as to recycle exhaust air thereby obviating energy losses associated with low ambient external temperatures, exhaust of the latent heat of vaporization of the moisture evaporated from the grain and the reduced drying capacity associated with high temperature and high humidity ambient conditions.

These and other objects, advantages and features of the invention will be set forth in a detailed description which follows.

BRIEF DESCRIPTION OF THE DRAWINGS

In the detailed description which follows, reference will be made to the drawings comprised of the following figures.

DESCRIPTION OF THE PREFERRED EMBODIMENT

Figure 1:
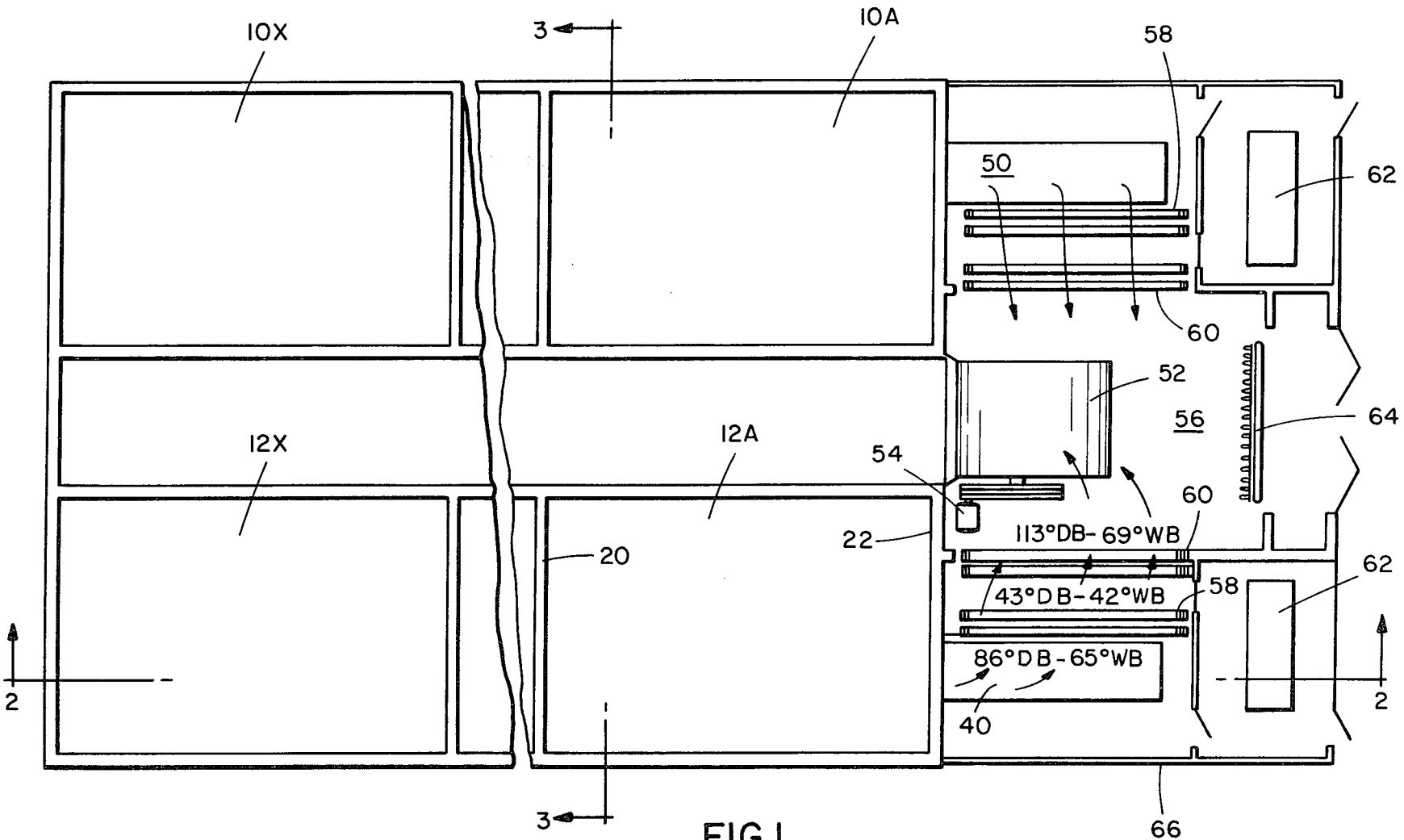
FIG. 1 is a top plan view of a first embodiment of the present invention which provides a double pass of air with air flow direction control.
Figure 2:
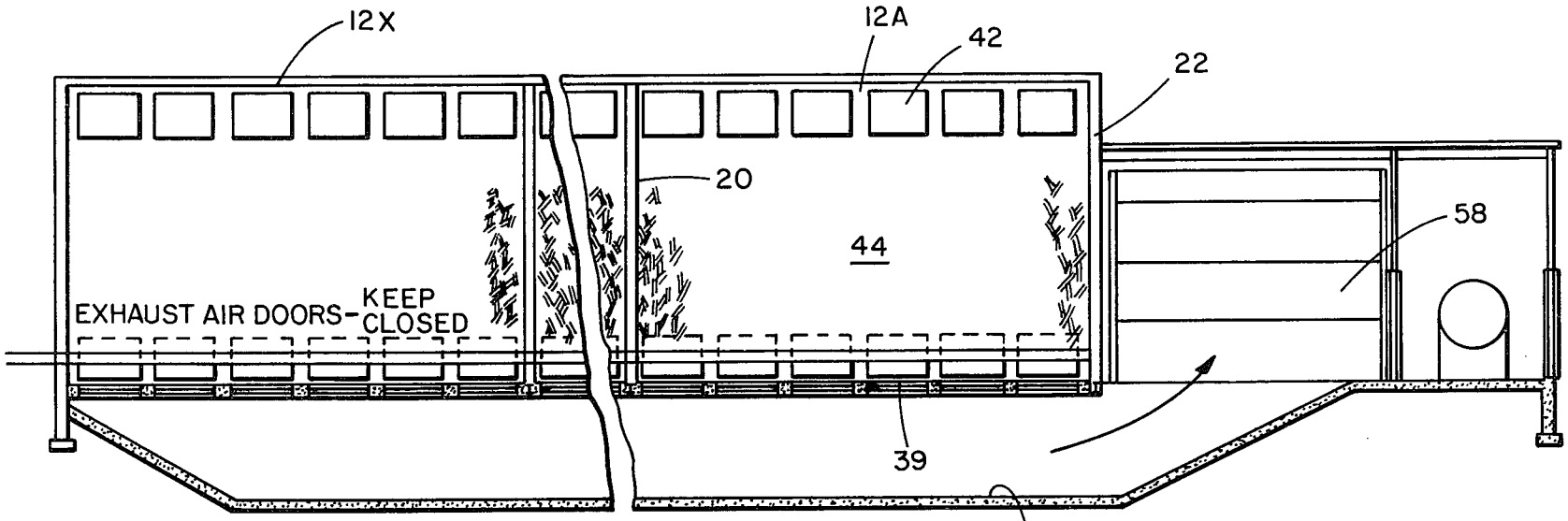
FIG. 2 is a cross-sectional view of the embodiment shown in FIG. 1 taken substantially along the line 2—2.
Figure 3:
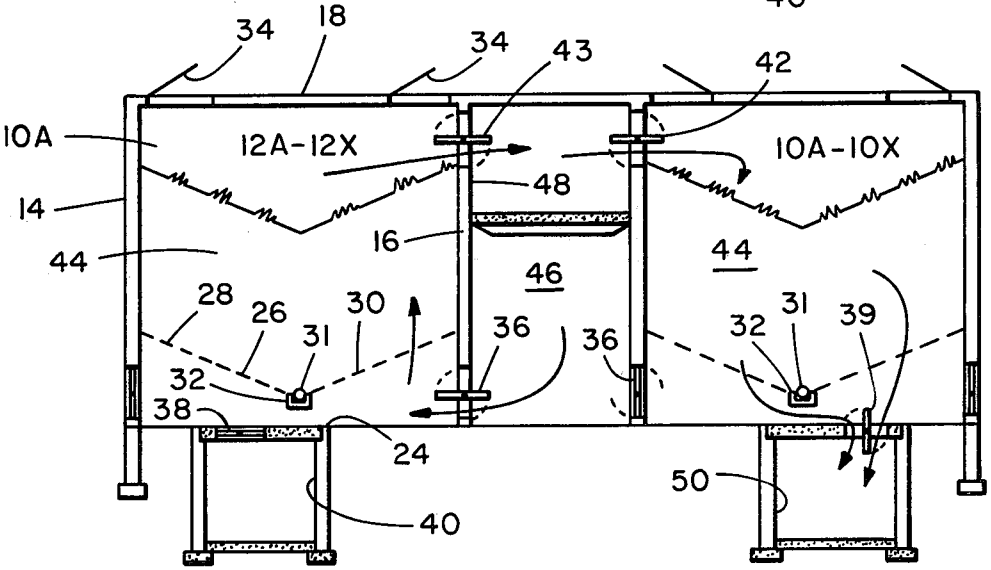
FIG. 3 is a cross-sectional view of the embodiment shown in FIG. 1 taken substantially along the line 3—3.

FIGS. 1, 2 and 3 depict a first embodiment of the invention. In terms of function, the dryer of FIGS. 1–3 permits double passage of drying air in reversible directions with a heat pump for reconditioning of the drying air. As shown, the batch grain dryer is comprised of at least two and preferably four or more separate grain bins 10A–10X and 12A–12X. Each bin 10, 12 is comprised of a pair of sidewalls 14 and 16, a top wall 18, a pair of opposite end walls 20 and 22 and a bottom surface or wall 24. The top wall 18 includes grain filling doors 34 through which wet grain or other products are delivered into the bin 10.

A hopper shaped perforated grain bed or grate 26 is provided adjacent the bottom wall 24. The hopper grate 26 is comprised of inclined perforated screens 28 and 30 which are preferably arranged at the angle of respose of grain placed in the bin 10 for drying or at an angle that will be provided for self cleaning of screens 28, 30. Screens 28, 30 are formed with a mesh adequate to prevent passage of grain and permit passage of air therethrough. A grain discharge channel 31 is defined at the junction of screens 28, 30. An auger or conveyor 32 is provided for removing dry grain from the channel 31.

Each bin 10A–10X and 12A–12X also includes a first drying air inlet door 36 in the side wall 16. Air return doors 38 and 39 are provided beneath the hopper 26 in each bin 10A–10X and 12A–12X respectively. Doors 38 and 39 connect with return air ducts 40 and 50 respectively.

An upper air transfer door 42 is provided in wall 16 for each bin 10A–10X above the level of grain 44 stored in the bins 10A–10X. An upper air transfer door 43 is also provided in the sidewall of each bin 12A–12X. One or more doors 36 may be provided for each bin 10A–10X and 12A–12X. Similarly, one or more doors 38 and 42–43 may be provided for each bin 10A–10X and 12A–12X.

The return air doors 38 and 39 are connected to a common return air manifold or ducts 40 and 50 respectively as previously described. In a similar fashion, the drying air inlet doors 36 are connected with a common supply duct or manifold 46. Transfer doors 42 and 43 connect with a separate common, transfer air duct 48.

Drying air supply duct 46 is supplied with relatively warm, dry air circulated by a blower 52. Air supplied through the duct 46 is, for example, 110° F. with low moisture content thereby providing adequate but not overheated drying conditions. Blower 52 is typically a spiral or squirrel cage blower driven by electric motor 54. The blower 52 is maintained in an air chamber 56 connected with duct 46.

Air is supplied to the air chamber 56 from the return air manifolds or ducts 40 and 50. These ducts 40 and 50 provide return air on the upstream side of coils 58 and 60 associated with a heat pump 62 before the return air is discharged into chamber 56. Thus, return air from ducts or manifolds 40 and 50 passes through coils 58 and 60, chamber 56, blower 52 and into duct 46 for recycling through bins 10A–10X and 12A–12X.

The coils 58 and 60 are the two sets of coils associated with a typical heat pump apparatus. Thus, coil 58 is the cold side coil of heat pump 62 and coil 60 is the hot side coil of heat pump 62. The air from ducts 40 and 50 at coil 58 is reduced in temperature thereby condensing moisture in the air. Run off trays (not shown) beneath coils 58 are provided to remove the condensed moisture from the dryer. The cool dry from coil 58 then passes through the second coil 60 where it is reheated for recycling by the blower 52.

Standby heat may be provided through the system by means of a burner, for example, gas burner 64. Outside air may also be provided, for example, through adjustable grills 66 in walls forming the air chamber. Outside air and standby heat are generally not required.

In operation, heated air passes into the warm, drying air ducts 46 through open, warm air duct doors 36 upward through screens 28, 30 of selected bins 10 and 12. Moisture from the grain in these bins becomes entrained in the moving air. The partially moisture laden air then passes through open upper transfer doors 42–43 into transfer duct or manifold 48 for transfer to other bins 10, 12 that do not receive air directly from the duct 46 since doors 36 of these other bins 10, 12 are closed.

The air then pases downward through the grain, out through open return air doors 38–39 and into one of the return air ducts or manifolds 40 or 50. The direction, sequence and temperature of air for each of the various bins 10 and 12 is controlled by opening or closing the doors 36, 38–39 and 42–43. Note that all the doors 36, 38–39, 42–43 may be closed for a particular bin when grain for that bin is being removed or placed in that bin 10, 12.

In this manner, a series of bins 10, 12 each having a separate batch of grain can be dried while some of the bins are being filled or grain is being removed therefrom. The sequence of operations of air flow and grain filling and grain removal is discussed in the reference U.S. Pat. No. 2,826,824, incorporated herewith by reference. An example of the operation and construction of the dryer shown in FIGS. 1–3 is set forth below:

Number of bins: six bins 30 × 20 × 20′ having an approximate capacity of 2000 bushels of seed ear corn per bin.

CFM: 200,000 CFM is provided to duct 46. The air temperature of low humidity air to the duct is approximately 113° F. dry bulb temperature, 69° wet bulb temperature. Duct size is approximately 10 × 13.

Heat pump: Total heat pump capacity is approximately 1020 tons cooling and 1120 tons heating. The heat coils 60 are supplied with 1120 GPM of condenser water at 125° F. reduced to 95° in bringing 200,000 CFM of air from 43° DB-42° WB-95% RH (relative humidity) to 113° DB-69°WB-9% RH. A small percent of the heat will under some conditions have to be rejected in order to maintain 113° temperature. Thus, a heat exchanger (not shown) may be required. This 200,000 CFM of air is delivered by blower 52, through duct 46 to be cycled through three, more or less, of the bins of partially dried grain, thereby reducing the temperature and increasing the humidity to an appropriate average of 92°DB-65°WB-35%RH. The air is then transferred by duct 48 through three, more or less, of the bins of highest moisture grain and then by means of the return air ducts 40 and 50 to the cooling coil 58 at an an approximent and average of 85.6°DB-65.2° WB-34%RH.

The cooling coils 58 are supplied with 800 GPM of evaporator water at 33° F. raising its temperature to 60° F.

The 200,000 CFM of air in passing through the cooling coils is reduced to 43°DB-42°WB-95%RH condensing 3060 pounds of water per hour from this air. This will reduce the moisture of approximately 3000 bushel (shelled) of ear seed corn from 30% kernel moisture to 12% per 24 hours. The velocity of the return air in the return air ducts 40 and 50 is approximately 2000 feet per minute. FIG. 1 illustrates the air temperature at coils 58, 60. Note also that coil 60 may require a heat rejection (not shown) to maintain the air temperature at a desirable level of about 110° F. or thereabouts. This results since the heat removed from the air at coil 58 plus the mechanical heat of the system tend to heat the air at coil 60 considerably above 110° F.

Figure 4:
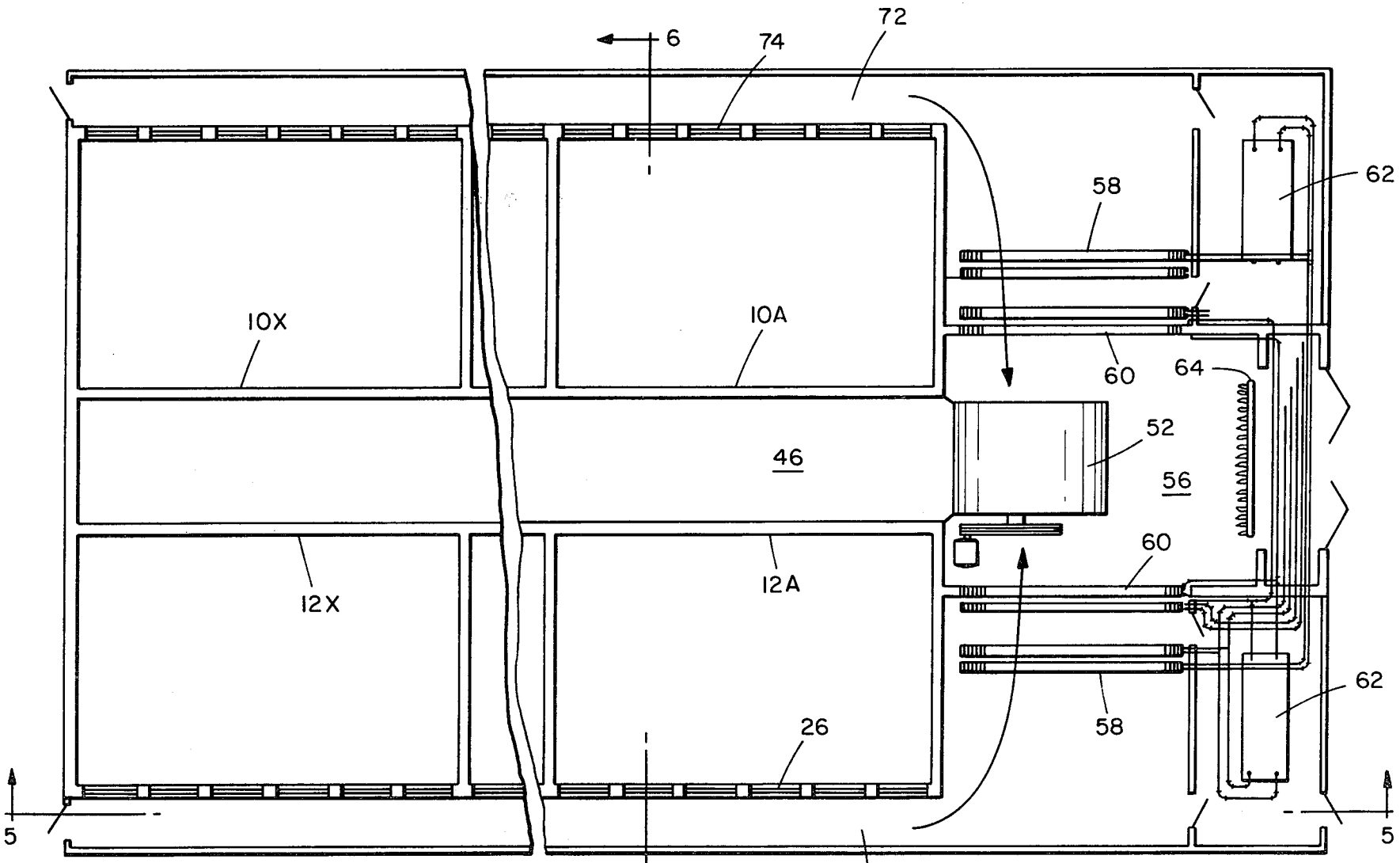
FIG. 4 is a plan view of an alternative embodiment of the invention which provides a single pass of air with air flow direction control.
Figure 5:
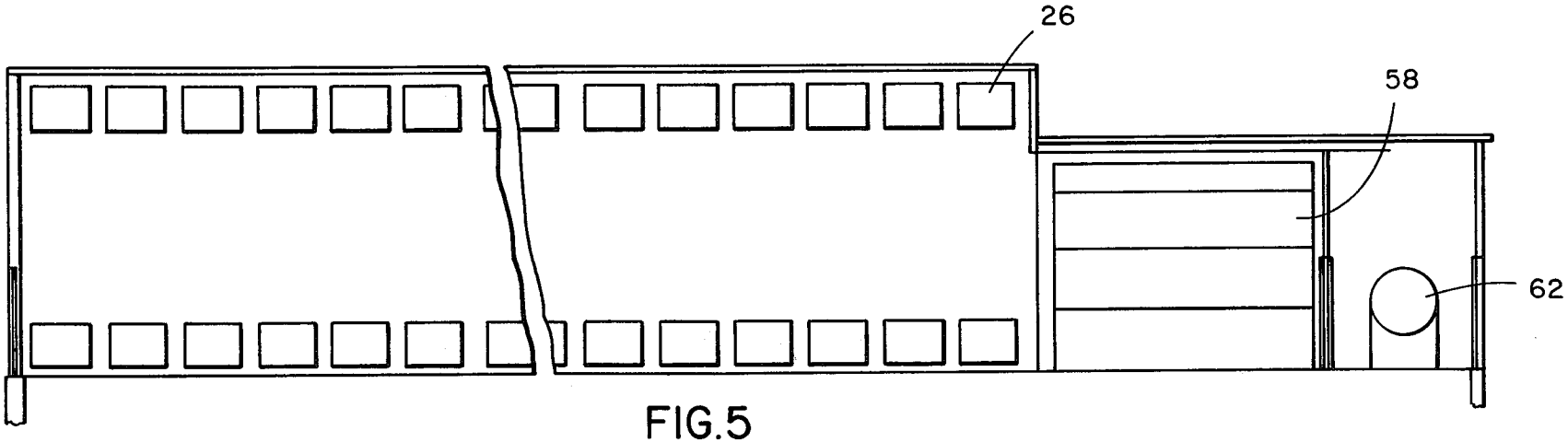
FIG. 5 is a cross-sectional view of FIG. 4 taken substantially along the line 5—5 in FIG. 4.
Figure 6:
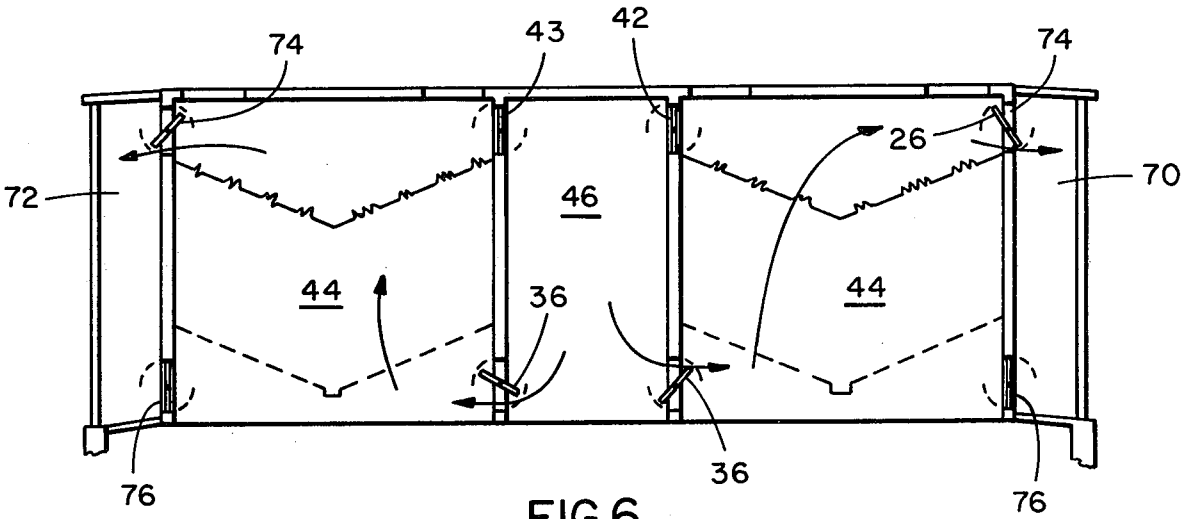
FIG. 6 is a cross-sectional view taken substantially along the line 6—6 in FIG. 4.

Reference is now directed to FIGS. 4–6. These figures illustrate an embodiment similar to that shown in FIGS. 1–3. However, return air duct 40–50 have been replaced by ducts 70 and 72. Therefore, the dryer of FIGS. 4–6 is identified as a single pass, reversible air direction dryer. Like parts in FIGS. 4–6 are labeled in the same manner as FIGS. 1–3. Additionally, the embodiment of FIGS. 4–6 includes return air doors 74 and 76.

Thus, air circulates from a single main supply duct 46 through inlet door 36, through the grain bed 44 and vents out return air door 74. The air is recycled continuously through the bin in this manner without any circulation from one bin to the other as discussed with regard to the embodiment shown in FIGS. 1–3.

Figure 7:
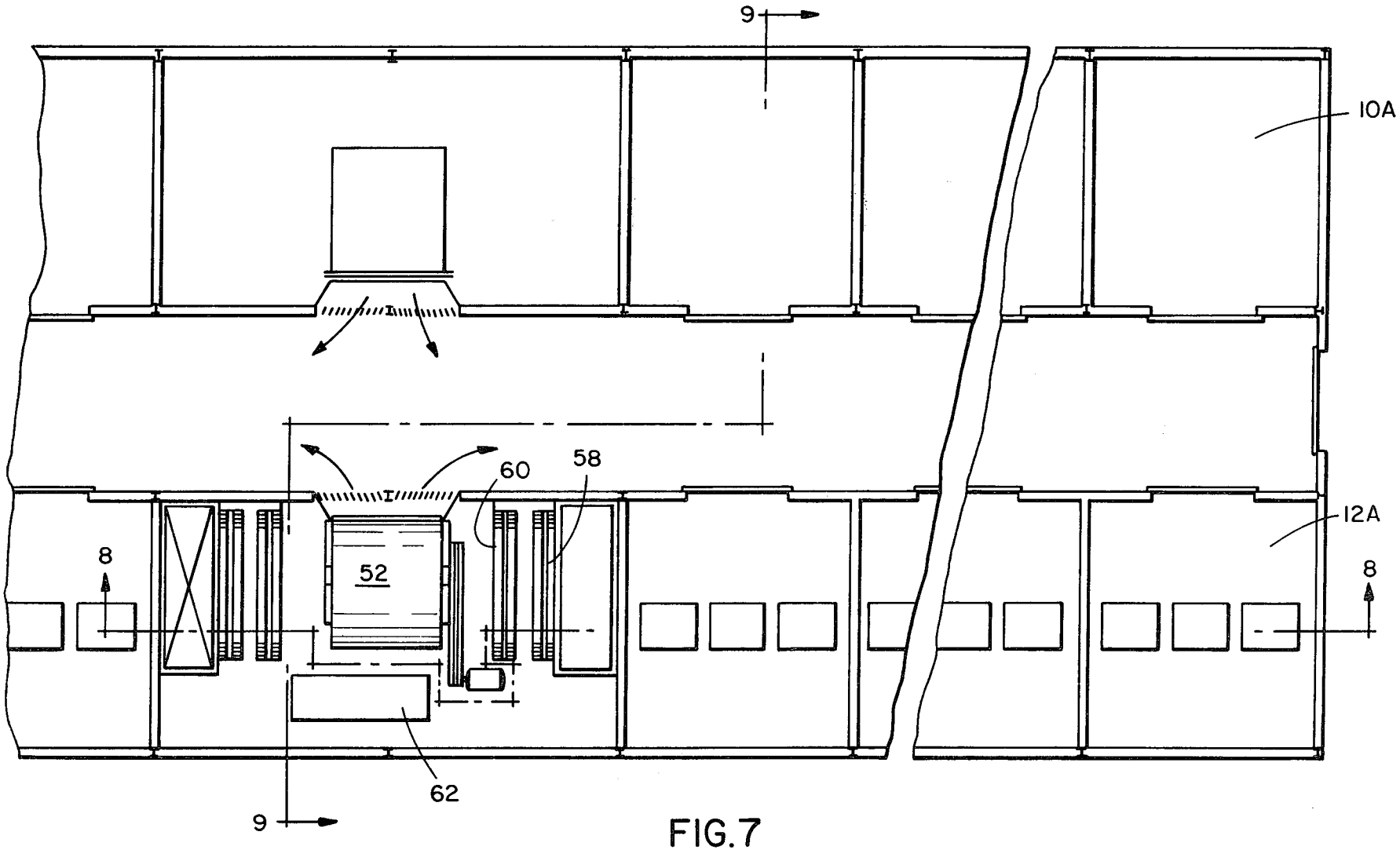
FIG. 7 is a third embodiment of the invention which provides double pass air flow.
Figure 8:
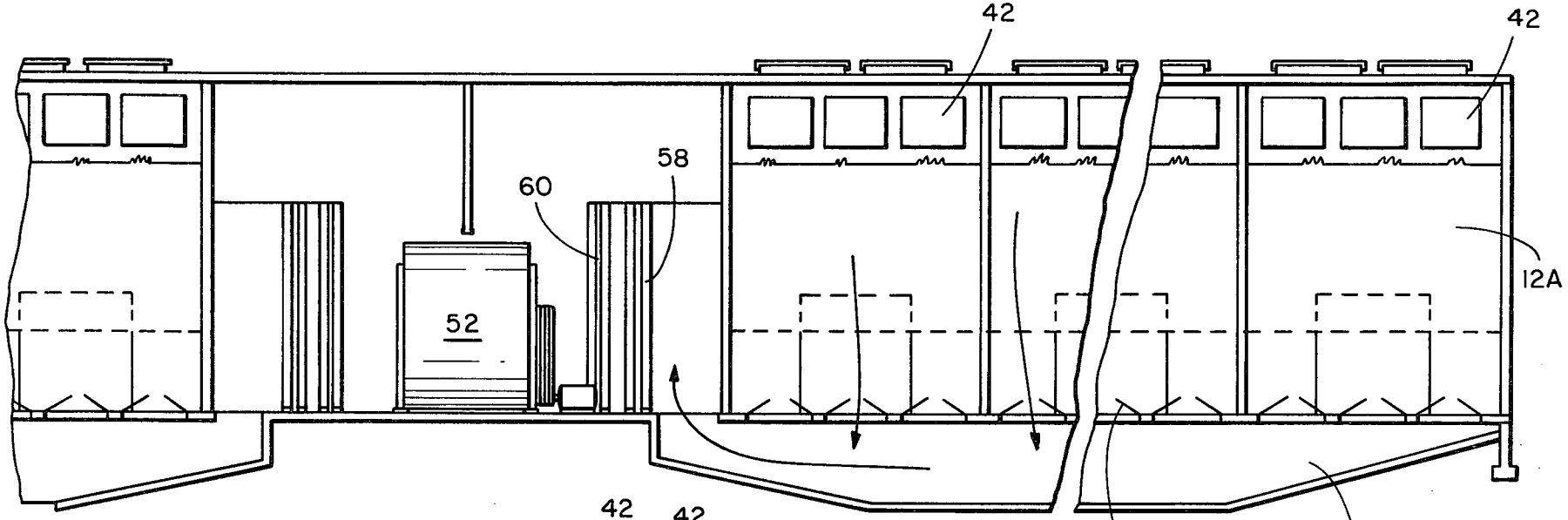
FIG. 8 is a cross-sectional view of the embodiment shown in FIG. 7 taken along the line 8—8.
Figure 9:
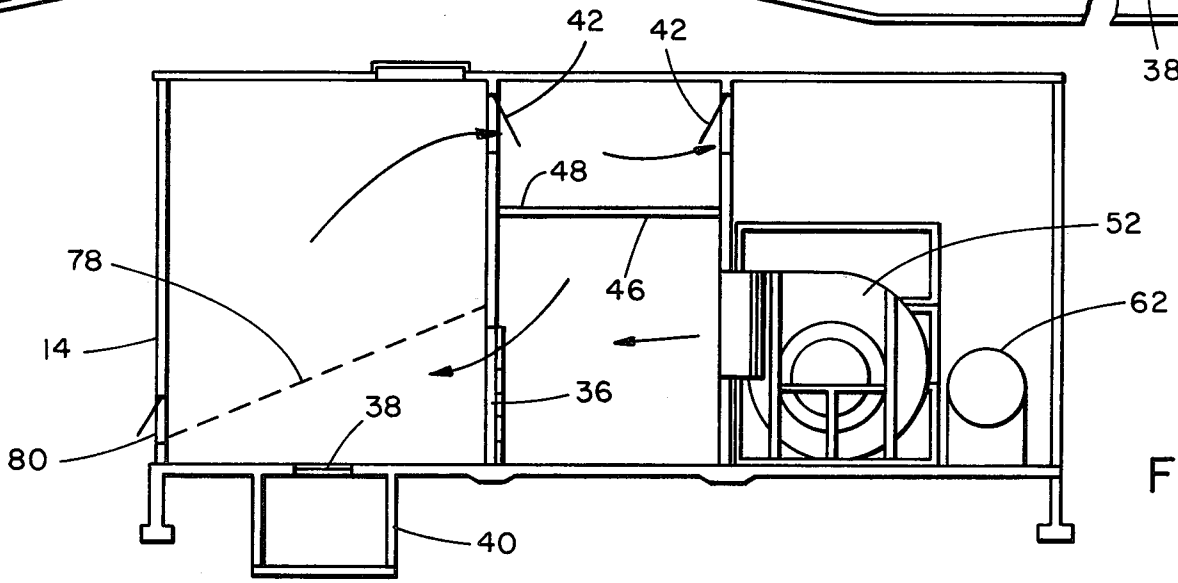
FIG. 9 is a cross-sectional view taken along the line 9—9 in FIG. 7.

FIGS. 7–9 show a third embodiment of the invention. The third embodiment is a double pass, reversible air flow direction device as was the first described embodiment. With the third embodiment, the grain bins are slightly altered in construction. That is, a grate 78 forms an angle with wall 14 and a grain discharge door 80 is substituted for the grain discharge conveyor. Return air ducts 40 and 50 are provided. The inlet doors 36, transfer doors 42, transfer duct 48 and return air doors 38 are all similar in construction and operation to the embodiment shown in FIGS. 1–3. However, the blower 52 and heat pump 62 are arranged intermediate the bins 10 and 12 rather than at one end. The operation and construction of the third embodiment batch grain dryer is otherwise the same as discussed with regard to the first embodiment of FIGS. 1–3.

It is possible to provide various alternative constructions and still remain within the scope of the invention. For example, a heater may be employed in place of the heat pump and a desiccator or desiccant material may be used to replace the cooling coil of the heat pump for removing moisture from the recycled air. Other arrangements of the blower and coil for the system are also possible. Thus, the invention is to be limited only by the following claims and their equivalents.

What is claimed is:

1. Improved apparatus for batch drying at least two batches of grain comprising, in combination:

first and second separate batch bins, each bin forming an enclosure for grain and having a top, a bottom and sides;

first and second separate air flow doors to each batch bin, at least one air flow door at the top of each bin and at least one air flow door at the bottom of each batch bin;

an air supply manifold connected to the bottom doors of each bin;

a second separate, air exhaust manifold connected to the top doors of each bin;

means for receiving, drying, reheating and discharging all of the air, the exhaust manifold being connected to said means for receiving all the air from the air exhaust manifold, said air supply manifold connected to said means for discharging all the air; and fan means for circulating all of the air continuously through said supply manifold, into said bins, through said exhaust manifold and said means for drying and reheating, whereby the air is entirely and continuously recycled through the batches of grain to remove moisture therefrom, the air temperature and moisture content being entirely controlled within the apparatus for drying independent of ambient conditions external the apparatus for batch drying.

2. The improved mechanism of claim 1 wherein said means for drying and reheating said air comprises heat pump means having a cooling coil upstream in the air flow from a heating coil and means for removing moisture from air at the cooling coil.

3. The improved apparatus of claim 1 including a desiccator as means for drying air from the exhaust manifold.

4. The improved apparatus of claim 1 including more than two bins and connecting means between the bins for air flow serially from at least one bin to another bin before recycling through the exhaust manifold.

5. The improved apparatus of claim 1 including an additional door at the top of each bin, said additional doors being connected with a separate air transfer manifold, said air transfer manifold providing for air flow intermediate two or more bins in serial order prior to exhaust through the exhaust manifold.

6. Improved apparatus for drying at least two batches of grain comprising, in combination:

first and second separate batch bins, each bin forming an enclosure for grain and having a top, a bottom and sides;

first and second separate air flow doors to each batch bin, at least one of said air flow doors at the top of each bin and the other of said air flow doors at the bottom of each batch bin;

an additional door at the top of each bin;

an air supply manifold connected to the bottom doors of each bin;

a second separate air exhaust manifold connected to the first top doors of each bin;

an air transfer manifold connected to the additional top doors of each bin;

all of said doors being operable to be placed in the open or closed condition;

means for receiving, drying, reheating and discharging all the air flow through the dryer, the exhaust manifold being connected to said means to receive all the air from the exhaust manifold, the air supply manifold connected to direct all the air from the means for discharging air, and said additional doors being connected with the air transfer manifold to provide air flow intermediate two or more bins in serial order prior to exhaust through the second doors to the exhaust manifold, whereby all the air is entirely and continuously recycled through the batches of grain and the means for drying and reheating by the path of the manifolds to remove moisture from each bath of grain, the air temperature and moisture content being entirely controlled within the apparatus for grain drying independent of ambient conditions, external the apparatus for drying.

* * * * *